United States Patent [19]

Eckstein

[11] Patent Number: 4,907,633

[45] Date of Patent: Mar. 13, 1990

[54] HANDBAG ASSEMBLY

[76] Inventor: Carol A. Eckstein, 2 Parkwood Rd., Hanover, Conn. 06350

[21] Appl. No.: 236,545

[22] Filed: Aug. 25, 1988

[51] Int. Cl.[4] ..... A45C 1/02; A45C 3/08; A45C 13/26

[52] U.S. Cl. ..... 150/105; 150/107; 150/113; 150/118; 190/110; 190/116; 383/13; 383/111

[58] Field of Search ..... 150/103–105, 150/107, 108, 113, 118, 117; 190/110, 116, 26; 383/11, 13, 43, 111, 120, 37

[56] References Cited

U.S. PATENT DOCUMENTS

| | | | |
|---|---|---|---|
| D. 257,297 | 10/1980 | Keller | 150/107 X |
| 1,224,396 | 5/1917 | McCleur | 383/120 X |
| 1,960,396 | 5/1934 | Rosenberg | 150/105 |
| 1,999,669 | 4/1935 | Smith . | |
| 2,051,092 | 8/1936 | Landis | 150/105 |
| 2,053,464 | 9/1936 | Dalsheim | 150/105 |
| 2,083,029 | 6/1937 | Lowy | 150/105 |
| 2,118,400 | 5/1938 | Goldberg | 150/105 |
| 2,131,382 | 9/1938 | Lobel | 150/105 |
| 2,311,847 | 2/1943 | Long | 150/117 X |
| 2,437,382 | 3/1948 | Czap | 150/105 |
| 2,464,312 | 3/1949 | Holden | 150/113 |
| 2,487,145 | 11/1949 | Kuhlman | 383/13 |
| 2,609,854 | 9/1952 | Rosen | 150/104 X |
| 2,671,487 | 3/1954 | Vander Hoek . | |
| 2,723,696 | 11/1955 | Kase | 150/105 |
| 2,899,999 | 8/1959 | Dobbs et al. . | |
| 3,414,033 | 12/1968 | Tucker | 150/104 |
| 3,451,454 | 6/1969 | Davis | 323/13 X |
| 3,533,459 | 10/1970 | Ody . | |
| 4,088,167 | 5/1978 | Schwartz | 383/13 X |
| 4,112,991 | 9/1978 | Barbaresi | 383/13 X |
| 4,263,951 | 4/1981 | Siegel . | |

FOREIGN PATENT DOCUMENTS

| | | | |
|---|---|---|---|
| 558835 | 6/1958 | Canada | 383/13 |
| 125568 | 4/1919 | United Kingdom | 150/103 |
| 635036 | 3/1950 | United Kingdom | 150/103 |
| 648544 | 1/1951 | United Kingdom | 150/105 |
| 698167 | 10/1953 | United Kingdom | 383/37 |

*Primary Examiner*—Sue A. Weaver
*Attorney, Agent, or Firm*—Albert W. Hilburger

[57] ABSTRACT

A handbag assembly according to which a variety of outer decorative coverings can be selectively attached to the main article carrying bag to suit the desired decor. The main article carrying bag, which has a bottom and opposed sidewalls, is of flexible but sturdy construction capable of supporting whatever is intended to be carried. The sidewalls terminate at an upper rim to which is attached a pair of opposed handles, for easily supporting the carrying bag and its contents. An outer decorative covering of a desired decor substantially envelops the main article carrying bag and is attached to the carrying bag at locations proximate to the upper rim. The handles may be removable from the carrying bag and changed according to the desired decor and may be of different functional designs. Elastic members may be provided to bias the opening of the bag to a closed position or, in the alternative, positive closure devices may be utilized.

10 Claims, 3 Drawing Sheets

HANDBAG ASSEMBLY

BACKGROUND OF THE INVENTION

I. Field of the Invention

The present invention relates to a handbag assembly according to which a variety of outer decorative coverings can be selectively attached to the main article carrying bag to suit the desired decor.

II. Description of the Prior Art

It has long been a tradition for women to carry handbags or purses containing various personal items which they wish to keep close to their person. Indeed, most women consider a handbag or purse as a necessity to support their daily activities. A handbag is used to contain a variety of items such as credit cards, photographs, credentials, glasses, checkbook, wallet, change purse, keys, tissues, stamps, note paper, personal address and phone directories, and the like.

Numerous styles and designs of handbags are available to satisfy the individual aesthetic preference of the user and to compliment particular garments or occasions. It is customary for a woman to own several different handbags, each being decoratively compatible with a different outfit, suit, dress, coat, shoes, belt or other items of clothing or accessories. In changing from one outfit to another as, for example, changing from a day time to an evening outfit, the woman generally selects a particular decorative purse for the particular outfit selected. It thus follows that the items carried in a particular purse must be changed from one to another which is more decoratively complimentary with the outfit to be changed into, whether it be for morning, afternoon, or evening wear. This change in outfit and the selection of an appropriate handbag usually involves the removal of its contents and the relocation of the contents into the handbag selected for the change in outfit. This transfer operation is necessarily troublesome, time consuming, and frequently results in misplacement or loss of articles.

There have been numerous attempts through the years to improve the ease of transferring articles from one handbag to another in a more efficient manner without dropping or losing articles. Many such improvements have been patented, witness, for example, U.S. Pat. Nos. 1,999,669 to Smith; 2,464,312 to Holden; 2,671,487 to Vander Hoek; and 3,451,454 to Davis. Each of these patents discloses an insert which is disposed to occupy substantially the entire internal cavity of the handbag. In some instances, as in Smith, Holden and Vander Hoek, the insert is provided with a plurality of individualized compartments to separate the various articles and thereby improve the ease with which they might be retrieved.

In the instance of U.S. Pat. No. 3,414,033 to Tucker, a smaller purse is releasably attached to an inner wall of a much larger handbag. The purse is provided with carrying pockets and other structure for holding smaller items. U.S. Pat. No. 3,533,459 to Ody discloses a handbag with a plurality of inner compartments for sorting out and holding a plurality of articles. The U.S. Pat. No. 4,263,951 to Siegel discloses a handbag construction with a removable organizer to which a plurality of smaller articles can be releasably attached. Even as each individual article can be withdrawn from the organizer, the organizer itself can be removed as a unit from the handbag.

SUMMARY OF THE INVENTION

It was with knowledge of the prior art as just described and difficulties experienced with known constructions that the present invention has been conceived and has now been reduced to practice. According to the present invention, an improved handbag assembly is disclosed according to which a variety of outer decorative coverings can be selectively attached to the main article carrying bag to suit the desired decor.

It is, accordingly, a primary object of the invention to provide a main article carrying bag of flexible material to which can be releasably attached an outer covering which overlies and substantially envelops the bag to thereby provide the desired decor. It may be desirable to releasably attach the bottom and/or the respective sidewalls of the outer covering to the respective parts of the main article carrying bag.

Another object of the invention is the provision of such a main article carrying bag having a pair of handles to remain attached to it at all times.

In another instance, the handles may be so formed as to have one aperture for receiving the wing members of the outer decorative covering and another aperture for receiving the hand of the user.

Still another object of the invention is the provision of such a construction in which one set of handles may readily be replaced with another set of handles consistent with the decor of the outer decorative covering. In another instance, shoulder straps may be provided as the replacement handles.

Another object of the invention is the provision of such a flexible main article carrying bag together with an outer decorative covering of flexible material which substantially conforms to and is congruent with the main carrying bag.

Still another object of the invention is the provision of such a handbag assembly in which the main article carrying bag is composed of sturdy but inexpensive material while the outer decorative covering is composed of any of a broad range of more expensive and attractive materials.

Other and further features, objects, advantages, and benefits of the invention will become apparent from the following description taken in conjunction with the following drawings. It is to be understood that the foregoing general description and the following detailed description are exemplary and explanatory but are not to be restrictive of the invention. The accompanying drawings which are incorporated in and constitute a part of the invention, illustrate some of the embodiments of the invention and, together with the description, serve to explain the principles of the invention in general terms. Like numerals refer to like parts throughout the disclosure.

DETAILED DESCRIPTION OF THE PREFERRED EMBODIMENTS

Figure 1:
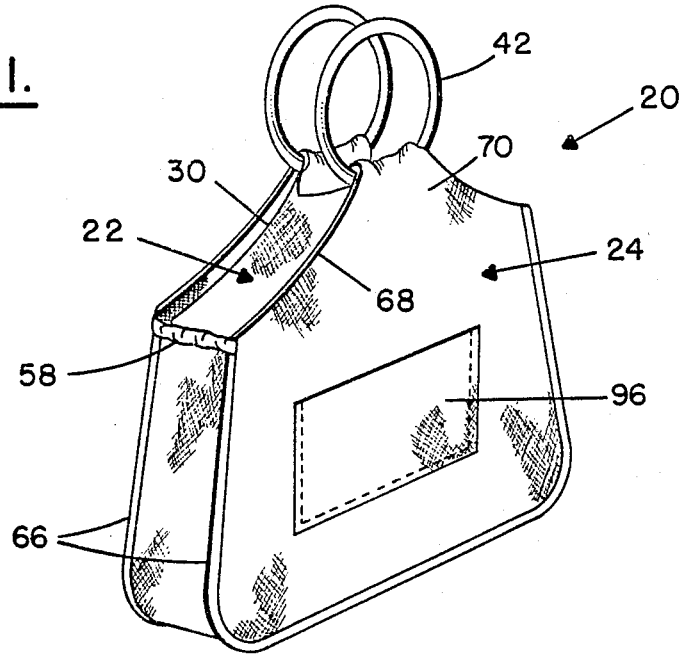
FIG. 1 is a perspective view of a handbag assembly embodying the invention.
Figure 2:
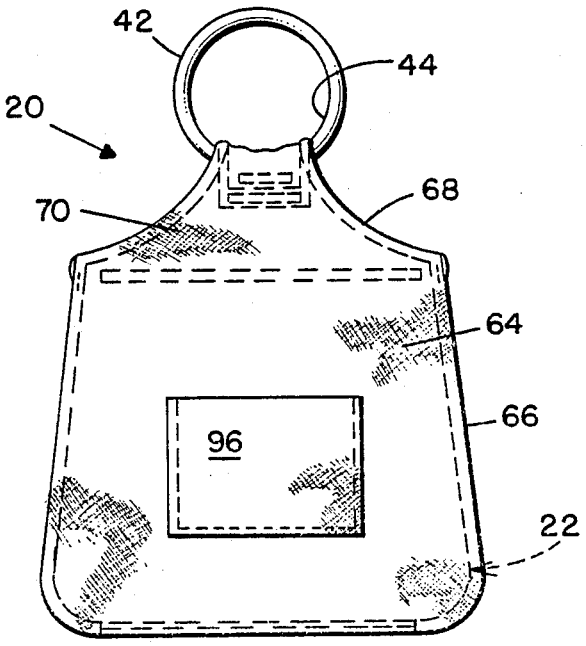
FIG. 2 is a side elevation view of the handbag assembly illustrated in FIG. 1.
Figure 3:
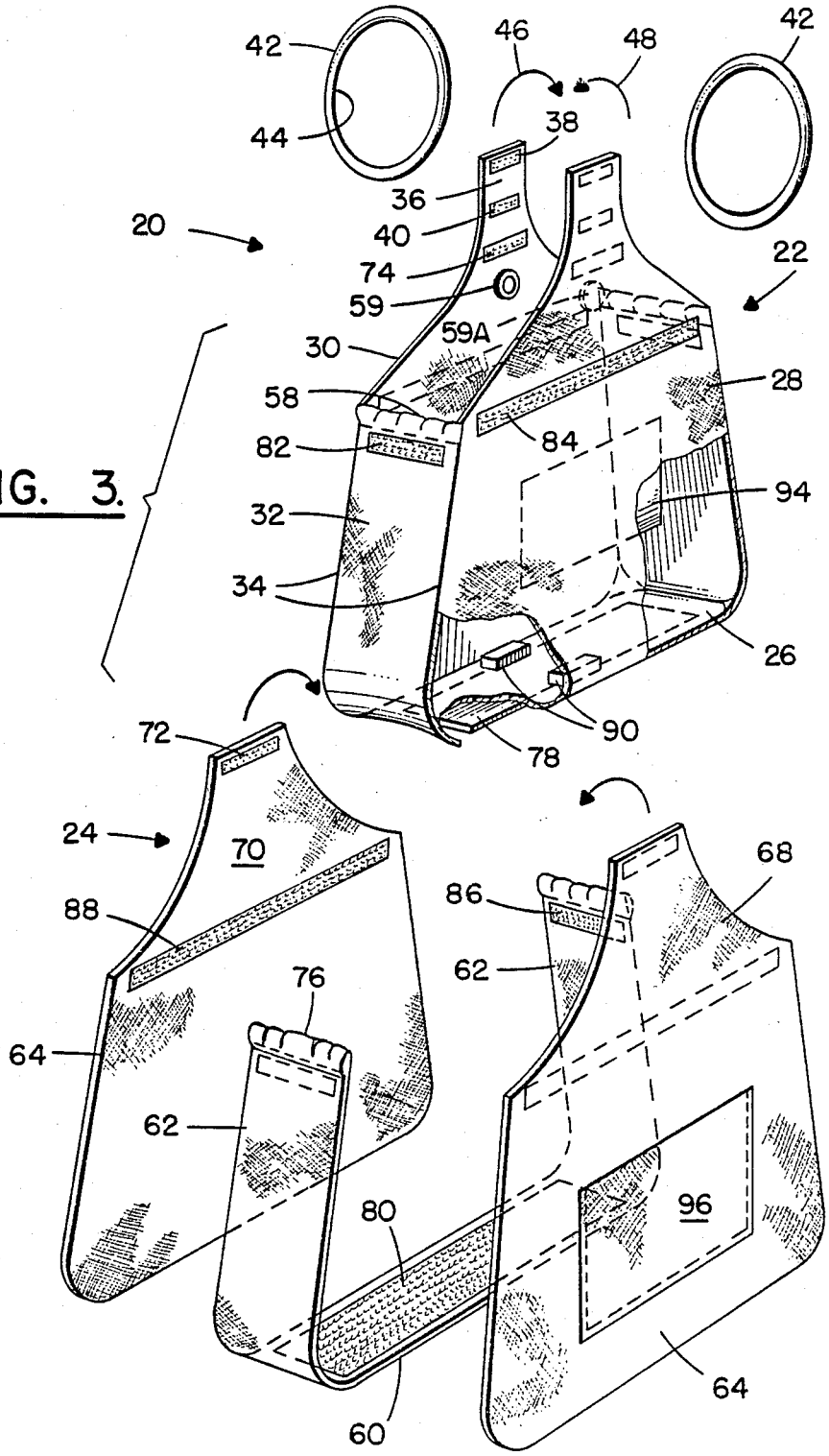
FIG. 3 is an exploded perspective view, certain parts being cut away and shown in section, of the handbag assembly illustrated in FIGS. 1 and 2 including both the main article carrying bag and the outer decorative covering.

Turn now to the drawings and initially to FIGS. 1, 2, and 3 which generally illustrate a handbag assembly 20 embodying the present invention. As illustrated, the handbag assembly 20 includes a main article carrying bag 22 and an outer decorative covering 24 associated with the main bag. The main bag 22 is preferably constructed of flexible but sturdy, wear resistant, sheet material. The material may be a fabric such as a relatively light canvas, although a variety of woven materials would be acceptable. Non woven sheet plastic materials such as heavy duty vinyl could also be considered. However none of these named materials should be restrictive of the scope of the invention.

In similar fashion, the materials of which the outer decorative covering may be fabricated would preferably be of a flexible sheet material, generally of higher grade than that of the main bag 22. Although preferably of higher grade, it is not necessarily to be expected that the material used for the outer covering 24 would have the wearability or even the sturdiness of that of the main bag. Thus, materials for the outer covering may include, but not necessarily be limited to, animal skins, even furs, simulated leather, or other artificial materials simulating still more expensive materials. Fabrics such as silk, wool, cotton, or the like may be employed and displaying any desired color or pattern suitable for the intended purpose of the handbag assembly. Again, however, none of these named materials should be restrictive of the scope of the invention.

As seen particularly well in FIG. 3, the main article carrying bag 22 has a bottom 26 and a pair of integral opposed sidewalls 28 which terminate at an upper rim 30 to define an opening into the bag 22. Opposed endwalls 32 may be integral with, and extensions of, the bottom 26 (see especially FIG. 3), then stitched, adhesive bonded, or heat bonded along seams 34 to the sidewalls 28 according to the material chosen for the bag 22. Of course, it is within the scope of the invention for the bottom 26, sidewalls 28, and endwalls 32 to be of one piece construction should that be desirable or, indeed of any number of pieces as may be desirable.

Figure 4:
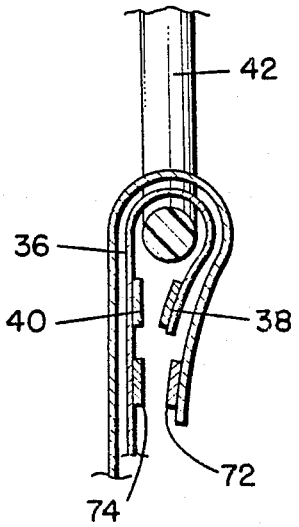
FIG. 4 is a detail cross-section view of certain components illustrated in FIGS. 1–3.

With continued reference to FIG. 3, a neck member 36 of reduced dimension and integral with each of the sidewalls 28, extends away from the upper rim 30. Mating components 38 and 40 of a hook and loop type fastener commonly available under the trademark "VELCRO" are mounted on each shoulder member 36 at spaced locations extending away from the upper rim 30 and generally disposed in spaced planes generally parallel to that of the opening into the bag 22. The fastener components 38, 40 serve to fixedly attach a handle 42 to each of the sidewalls 28. The handle 42 may be formed of any suitable material and of any suitable shape which serves to define an aperture 44 for reception of the neck member 36. When a segment of the handle 42 is positioned contiguous with the neck member 36 between the fastener components 38, 40, the extreme end of the neck member 36 is folded around the handle in the directions of arrows 46, 48, respectively, as seen in FIG. 3, and also as seen in FIG. 4, until the component 38 is matingly engaged with the component 40. When this occurs, the handle 42 is firmly attached to the sidewall 28 and, therefore, to the main bag 22.

Figure 5:
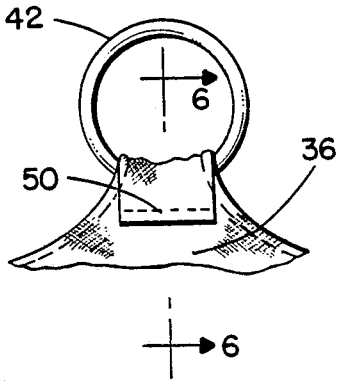
FIG. 5 is a detail side elevation view of another embodiment of the invention.
Figure 6:
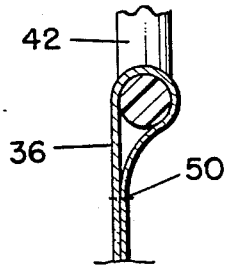
FIG. 6 is a detail cross-section view generally taken along line 6—6 in FIG. 5.

Although the fastener components 38, 40, have been described as being of the hook and loop type variety, it will be understood that other forms of fasteners would be suitable for purposes of the invention, such as snap-type fasteners. It may also be desirable to more permanently attach each of the handles 42 to its associated neck member 36. This may be achieved by means of stitching, as indicated at 50, in FIGS. 5 and 6. With this construction, the handles 42 are more securely attached to the main bag 22 than in the previously described embodiment. Of course, a benefit of the embodiment illustrated most clearly in FIGS. 3 and 4 using the fastener components 38, 40, is that handles 42 of different shapes, materials, and decor can be readily exchanged, and this ability supports a primary feature of the present invention.

Figure 7:
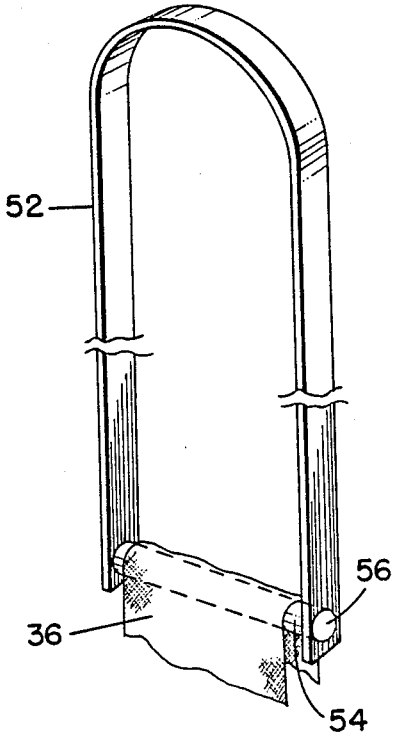
FIG. 7 is a detail perspective view illustrating another form of a handle which can be used with the invention.

Also, as illustrated in FIG. 7, an elongated shoulder strap 52 can be used in place of each of the handles 42. As seen in FIG. 7, a preferably rigid bight member 54 of appropriate construction is suitably fixed at its opposite ends, as by screws 56, or other suitable fasteners, to opposed ends of the shoulder strap 52. The neck member 36 associated with each sidewall 28 is received around the bight member 54 and secured in any suitable manner, including the manner of any of the constructions already described.

As seen in FIGS. 1 and 3, suitable elastic material 58 may be provided transversely of the endwalls 32 at their upper ends serving to bias the main bag 22 toward a closed position. Other constructions for biasing the upper rim 30 of the main bag 22 to a closed position might be contemplated including an elastic member which extends across the sidewalls 28 as well as across the endwalls 32, or perhaps a draw string on the sidewalls 28 and endwalls 32 and encircling the upper rim 30. Positive closure devices may also be used such as mutually engageable snap fasteners 59, 59A provided on the inner surfaces of the opposed sidewalls 28 below the upper rim 30. Other suitable closure devices may also be used such as zipper-type closures.

With continued reference to FIG. 3, the outer decorative covering 24 may be of a construction similar to that of the main bag 22. With such a construction, it is seen to have a bottom 60 and opposed endwalls 62 which are integral with the bottom. It is also seen to have a pair of opposed sidewalls 64 which may be joined along seams 66 as by adhesive bonding, heat bonding, stitching, or the like, depending upon the particular material of which the outer covering is composed. Of course, as previously mentioned with respect to the main bag 22, the outer covering 24 may be of one piece construction or of more than one piece should that be desirable. In any event, the outer covering 24 terminates at an upper rim 68 (FIGS. 1–3) which defines an opening into the interior of the outer covering.

Each of the sidewalls 64 includes a pair of integral wing members 70 of reduced dimension extending away from the upper rim 68. One component 72 of a hook and loop type fastener such as that commercially available under the trademark "VELCRO" is suitably provided adjacent and uppermost edge of the wing member 70. The fastener component 72 is matingly engageable with an associated fastener component 74 suitably provided on the inside surface of the sidewall 28. Thus, as best seen in FIGS. 1, 2, and 4, the main bag 22 is intended for reception within, and in close fitting relationship with, the interior of the outer covering 24. When this is achieved, each of the wing members 70 is received through the aperture 44 of its associated handle 42, then folded around the handle to extend into the interior of the bag 22. Thereupon, each fastener component 72 is matingly engaged with its associated fastener component 74 thereby mutually joining the upper portions of the main bag 22 and the outer covering 24. When this occurs, the outer covering overlies and substantially envelopes the bag. As with the bag 22 and its provision of elastic material 58 to bias it closed, the outer covering 24 may similarly be provided with elastic material 76 at upper ends of the endwalls 62 to similarly bias closed the opening into the interior of the outer covering 24.

In order to firmly affix the outer covering 24 to the main bag 22, it may be desirable to provide matingly engageable hook and loop type fasteners to prevent relative movement between the bottoms 26 and 60. For this purpose, as seen in FIG. 3, one such fastener component 78 is suitably fixed to an under surface of the bottom 26 and is matingly engageable with a fastener component 80 fixed to an upper surface of the bottom 60. Thus, when the bag 22 is received within the outer covering 24, the fastener components 78, 80 are joined and prevent such undesired relative movement between the two major components of the invention.

In a similar manner, hook and loop type fastener components 82, 84 may be suitably provided on the outer surfaces of the endwalls 32 and sidewalls 28, respectively, for mating engagement with associated fastener components 86 and 88 provided, respectively, on the endwalls 62 and sidewalls 64. Thus, when the bag 22 is received within the interior of the outer covering 24, and the bottoms 26 and 60 are in a contiguous relationship such that the fastener components 78, 80 are joined, the fastener components 82, 86 are similarly joined as are the mating components 84 and 88. By reason of this construction, undesired entry into the space between the bag and the outer covering is substantially prevented. While the fastener components 82, 84 and 86, 88 are illustrated as being discontinuous, in fact, they may be two continuous matingly engageable strips should that be desired.

Another way of assuring that the main bag 22 will substantially conform to the outer covering 24 is by the provision of weights 90 of any suitable nature and construction. The weights which may be of any suitable, relatively dense, material may be sewn or otherwise attached to the bottom 26 of the bag 22. They may be used alone or in conjunction with the fastener components 78, 80 and aid in drawing the bottom 26 into position conforming to the bottom 60 of the outer covering 24.

Figure 8:
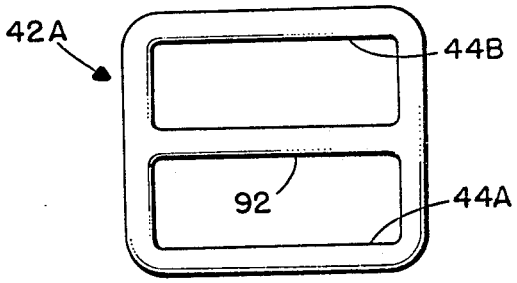
FIG. 8 is an elevation view illustrating still another form of a handle which can be used with the invention.
Figure 9:
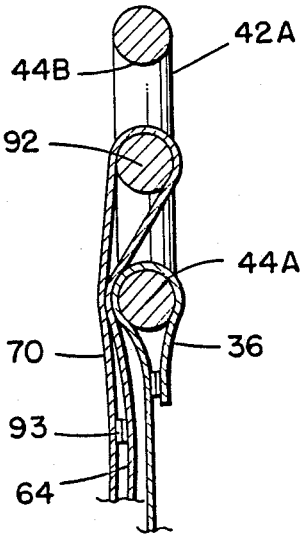
FIG. 9 is a cross section view taken through the handle of FIG. 8 to illustrate another mode of attaching the outer decorative covering to the main article carrying bag.

It was previously explained that the handles 42 may be of a variety of shapes. In FIG. 8, a modified handle 42A is illustrated which is provided with a pair of apertures separated by a central bar 92. One such aperture 44A serves to receive the neck member 36 of its associated sidewall 28 and the wing member 70 of its associated sidewall 64 while the aperture 44B serves to receive the hand of the person carrying the handbag assembly 20. By reason of the modified handle 42A, as depicted in FIGS. 8 and 9, each wing member 70 can be directed through the aperture 44A, then around the central bar 92, for eventual attachment to the outer surface of the sidewall 64 by means of fasteners collectively illustrated at 93. This construction, therefore, does not require that the wing members 70 extend into the interior of the main bag 22.

Figure 10:
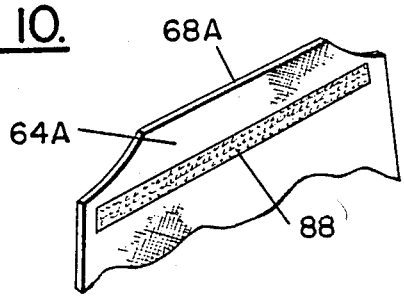
FIG. 10 is a detail perspective view depicting still another form of the outer decorative covering of the invention.

The disclosure up to this point has called for each of the sidewalls 64 of the outer covering 24 to have a wing member 70 which is received through the aperture 44 of its associated handle 42, then folded around the handle for attachment to the interior of the main bag 22. However, it will be understood that while this is a highly desirable construction, it is also contemplated that the wing members might be eliminated in the manner illustrated in FIG. 10. FIG. 10 illustrates a modified sidewall 64A with a modified upper rim 68A which is generally parallel to the plane of the bottom 60. The fastener component 88 need not be altered from that of the FIG. 3 embodiment and serves the same purpose. Of course, in this embodiment, it would be desirable for the upper exposed portion of the main bag 22 to be aesthetically pleasing since its upper regions are not covered by the wing members 70 as they are in the FIG. 3 embodiment.

With the construction just disclosed, then, the handbag assembly 20 enables a woman to rapidly and easily remove an outer covering 24 from the main bag 22 and replace it with another outer covering of a different decor. While so doing, the contents of the main bag 22 remain unaffected and can at all times be supported by means of the handles 42 which are attached thereto. Also, the embodiment illustrated in FIGS. 1–4 provides for removal and replacement of the handles 42 according to the chosen decor. Indeed, for particular occasions, the shoulder strap 52 of FIG. 7 may even be a desired alternative.

It may be desirable to provide a pocket 94 on an interior surface of one of the sidewalls 28 for holding those items for which the user desires to have ready access. A similar pocket 96, for a similar purpose, may also be provided on at least one of the sidewalls 64 of the outer covering 24.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A handbag assembly comprising:

a main article carrying bag of flexible material having a first bottom and a pair of integral opposed first sidewalls terminating at a first upper rim defining an opening into said carrying bag;

an outer decorative covering of flexible material selectively attachable to and removable from said carrying bag, said outer decorative covering having a second bottom and a pair of integral opposed second sidewalls terminating at a second upper rim defining an opening into said outer decorative covering and including a pair of integral wing members of reduced dimension extending away from said second upper rim on opposite sides of said outer decorative covering;

first fastener means on a surface of said carrying bag adjacent said first upper rim;

second fastener means on a surface of each of said wing members; and handle means having at least one aperture therethrough mounted to each of said first sidewalls adjacent said first upper rim for holding and transporting said carrying bag and its contents during use and for simultaneously supporting both of said first sidewalls during attachment of said outer decorative covering to said carrying bag and removal of said outer decorative covering from said carrying bag, each of said wing members being received through the aperture of an associated one of said handle means and folded around said handle means to extend into the interior of said carrying bag or attaching said outer decorative covering to said carrying bag;

said first fastener means being selectively matingly engageable with said second fastener means to thereby secure said outer decorative covering to said carrying bag such that said outer decorative covering overlies and substantially envelops said carrying bag.

2. A handbag assembly as set forth in claim 1 including:

mutually engageable closure means, respectively, on the interior opposed surfaces of said carrying bag proximate to said first upper rim for selectively closing the opening into said carrying bag for preventing undesired entry into said carrying bag and unintended release of the contents of said carrying bag.

3. A handbag assembly as set forth in claim 1 including:

mutually engageable attachment means, respectively, on the exterior surface of said first bottom and on the interior surface of said second bottom for preventing undesired relative movement of said first and second bottoms.

4. A handbag assembly as set forth in claim 1 including:

elastic means biasing at least one of said first and second rims toward a closed position to aid in preventing unintended release of the contents of said carrying bag from said handbag assembly.

5. A handbag assembly as set forth in claim 1 wherein said handle means are fixed to said carrying bag.

6. A handbag assembly as set forth in claim 1 including:

attachment means for releasably attaching said handle means to said carrying bag.

7. A handbag assembly as set forth in claim 6 wherein said carrying bag has a pair of neck members of reduced dimension integral with each of said first sidewalls and extending away from said first upper rim on opposite sides of said carrying bag;

wherein said handle means includes a pair of handles, each of said handles including a bight member and an elongated flexible strap member fixed to opposite ends, respectively, of said bight member, said bight member and said strap member together defining the aperture therethrough, said neck member associated with each of said handles extending through the aperture and being joined to itself thereby fixing said handles to said carrying bag.

8. A handbag assembly comprising:

a main article carrying bag of flexible material having a first bottom and a pair of integral opposed first sidewalls terminating at a first upper rim defining an opening into said carrying bag and a pair of neck members f reduced dimension integral with each of said first sidewalls and extending away from said first upper rim on opposite sides of said carrying bag;

a handle mounted to each of said first sidewalls adjacent said first upper rim for holding and transporting said carrying bag, each of said handles having at least one aperture therethrough;

an outer decorative covering having a second bottom and a pair of integral opposed second sidewalls terminating at a second upper rim defining an opening into said outer decorative covering, said outer decorative covering overlying and substantially enveloping said carrying bag and including a pair of integral wing members of reduced dimension extending away from said second upper rim on opposite sides of said outer decorative covering;

first fastener means on an interior surface of each of said neck members;

second fastener means on an interior surface of each of said wing members;

each of said wing members being received through the aperture of an associated one of said handles and folded around said handle to extend into the interior of said carrying bag, each of said first fastener means being selectively matingly engaged with its associated one of said second fastener means to thereby secure said outer decorative covering to said carrying bag;

third and fourth spaced, matingly engageable, fastener means on each of said neck members, respectively, generally aligned in a direction extending between said first upper rim and said first bottom;

each of said neck members being received through the aperture of an associated one of said handles and folded around said handle, said third and fourth fastener means being mutually engaged to thereby releasably mount said handles to said carrying bag.

9. A handbag assembly as set forth in claim 8 wherein each of said handles has one hand receiving aperture therethrough and another aperture therethrough for receiving an associated one of said neck members.

10. A handbag assembly comprising:

a main article carrying bag of flexible material having a first bottom and a pair of integral opposed first sidewalls terminating at a first upper rim defining an opening into said carrying bag and a pair of neck members of reduced dimension integral with each of said first sidewalls and extending away from said first upper rim on opposite sides of said carrying bag;

a handle mounted to each of said sidewalls adjacent said first upper rim for holding and transporting said carrying bag, each of said handles having a central bar separating first and second apertures therethrough;

an outer decorative covering having a second bottom and a pair of integral opposed second sidewalls terminating at a second upper rim defining an opening into said outer decorative covering, said outer decorative covering overlying and substantially enveloping said carrying bag and including a pair of integral wing members of reduced dimension extending away from said second upper rim on opposite sides of said outer decorative covering;

first and second spaced, matingly engageable, fastener means, respectively, on each of said wing members and on each of said second sidewalls;

each of said wing members being received through the first aperture of an associated one of said handles and received around said central bar to extend through the second aperture in the opposite direction, each of said first fastener means being matingly engaged with its associated one of said second fastener means to thereby secure said outer covering to said carrying bag;

third and fourth spaced, matingly engageable, fastener means on each of said neck members, respectively, generally aligned in a direction extending between said first upper rim and said first bottom;

each of said neck members being received through the second aperture of an associated one of said handles and folded around said handle, said third and fourth fastener means being mutually engaged to thereby releasably mount said handles to said carrying bag.

* * * * *